US005690537A

United States Patent [19]

Kalmus

[11] Patent Number: 5,690,537

[45] Date of Patent: Nov. 25, 1997

[54] PROTECTIVE BRASSIERE WITH REMOVABLE MOUNTED INSERTS OF ELECTRICALLY CONDUCTIVE MATERIAL

[76] Inventor: Phyllis Kalmus, 3592 Carrollton Ave., Wantagh, N.Y. 11793

[21] Appl. No.: 574,327

[22] Filed: Dec. 18, 1995

[51] Int. Cl.[6] ..... A41C 3/10; A41C 3/12; A41C 3/14

[52] U.S. Cl. ..... 450/57; 450/54; 450/55; 450/93; 2/267; 2/46; 2/463

[58] Field of Search ..... 450/1, 30, 31, 450/32, 53, 54, 55, 56, 57, 93; 2/2.5, 463, 464, 468, 48, 46, 50, 51, 243.1, 267; 250/515.1, 516.1

[56] References Cited

U.S. PATENT DOCUMENTS

| | | | |
|---|---|---|---|
| 3,135,961 | 6/1964 | Roderick | 2/464 |
| 3,176,686 | 4/1965 | Barnes | 2/463 |
| 3,478,739 | 11/1969 | Librande | 2/463 |
| 4,992,335 | 2/1991 | Guerra et al. | 428/518 |
| 5,395,280 | 3/1995 | Greenberg | 2/267 X |

FOREIGN PATENT DOCUMENTS

| | | | |
|---|---|---|---|
| 2294657 | 7/1976 | France | 450/55 |

*Primary Examiner*—Jeanette E. Chapman

[57] ABSTRACT

A protective brassiere that protects the delicate breast tissue and the related glandular areas from harmful radiation. The protective brassiere includes a generally concave-shaped right cup, a generally concave-shaped left cup that is disposed adjacent to the generally concave-shaped right cup, a generally elongated right side panel that is disposed adjacent to the generally concave-shaped right cup, a generally elongated left side panel that is disposed adjacent to the generally concave-shaped left cup, a removably mounted generally convex-shaped right cup protective insert of electrically conductive material that is removably mounted to the generally concave-shaped right cup, a removably mounted generally convex-shaped left cup protective insert of electrically conductive material that is removably mounted to the generally concave-shaped left cup, a removably mounted generally elongated right side panel protective insert of electrically conductive material that is removably mounted to the generally elongated right side panel, and a removably mounted generally elongated left side panel protective insert of electrically conductive material that is removably mounted to the generally elongated left side panel.

16 Claims, 3 Drawing Sheets

PROTECTIVE BRASSIERE WITH REMOVABLE MOUNTED INSERTS OF ELECTRICALLY CONDUCTIVE MATERIAL

BACKGROUND OF THE INVENTION

The present invention relates to a protective brassiere. More particularly, the present invention relates to a protective brassiere with removably mounted inserts of electrically conductive pliable carbon material.

With today's increasing concern about breast cancer and with the uncertainty of where the causes of this life threatening disease lie, women need to protect themselves as much as possible.

There are more women in the workplace today, and with the possible hazards of low-frequency electric and magnetic fields emanating from computer display terminals especially over long periods of time, this source of radiation can not be overlooked.

Numerous innovations for protective garments and fabrics have been provided in the prior art that will be described. Even though these innovations may be suitable for the specific individual purposes to which they address, however, they differ from the present invention in that they do not teach a protective brassiere with removably mounted inserts of electrically conductive pliable carbon material.

For example, U.S. Pat. No. 4,196,355 to Maine teaches a two-piece radiation shield garment for the human body that includes an adjustably overlapping vest to protect the upper body and a wraparound skirt to protect the lower body. The vest and skirt are constructed of multiple inner layers of flexible radiation shielding material covered with nonshielding fabric or other material. The vest and skirt include a rear shield panel joined to a pair of overlapping front shield panels. The overlapping front shield panels of the vest and skirt have wide cooperating horizontal bands of VELCRO (™) type tape closures.

Another example, U.S. Pat. No. 4,296,855 to Blalock teaches an electrically conductive fabric that includes filler and warp yarns of an electrically insulating material suffused with electrically conducting carbon particles. The warp and filler are woven in an open mesh configuration which is secured by a weave and a vulcanized elastomeric material that surrounds the yarns.

Still another example, U.S. Pat. No. 5,092,683 to Egonwurr teaches a high-strength synthetic fiber fabric that includes electrically conductive threads in addition to electrically nonconducting threads. The electrically conductive threads have electrically conductive carbon dispersed therein. The electrically conductive threads consist of polyolefin and are incorporated both in the warp and in the filling of the fabric.

Yet another example, U.S. Pat. No. 5,102,727 to Pittman et al. teaches an electrically conductive textile fabric that includes a conductivity gradient created by varying the relative concentration of high and low conductivity yarns during construction of the fabric. In the case of woven and knitted fabrics, the relative number of high and low conductivity yarns per inch may be varied in the warp and/or weft directions.

Still yet another example, U.S. Pat. No. 5,103,504 to Zoran teaches a textile fabric that shields from electromagnetic radiations and includes threads spun of textile fabrics containing cotton, and of steel fibers having a diameter of 6 to 10 mu. The number of mixed yarn threads in each of the warp direction and in the weft direction is 18 to 20 threads per cm, and the yarn fineness of the textile fabric is 38 to 40 tex.

Yet still another example, U.S. Pat. No. 5,115,140 to Rodriguez teaches an electromagnetic interference, radio frequency interference, and microwave body shield composition that includes a copper base having a coating applied thereon by electroless deposition which may be applied directly to a fabric or other substrate which is inserted into wearing apparel.

Still yet another example, U.S. Pat. No. 5,247,182 to Servant et al. teaches an article of protection of gonadal areas of a human body against radiation. The article includes an elongated sheet of fabric material with a first end and a second end and having a width of 10–30 cm, at least two complementary fastener means, and a layer of flexible radiation protection material with a width of 10–30 cm and extending longitudinally from the second end towards the first end.

Yet still another example, U.S. Pat. No. 5,288,544 to Mallen et al. teaches operating fabric articles that include a synthetic substrate which has been treated to render it absorbent to aqueous media, and an anti-statically effective amount of a conductive fiber.

Still yet another example, U.S. Pat. No. 5,308,667 to Calhoun et al. teaches a web of normally tacky and pressure-sensitive adhesive that is rendered electrically conductive by imparting a pattern of electrically conductive elements that extend from slightly beyond one face of the web to slightly beyond the other face of the web. The adhesive web is sandwiched between release liners formed of uniaxially oriented film and a conductive thread stitched through both the liners and the adhesive web. The liners can be removed by tearing along the stitch lines to create an electrically conductive adhesive web.

Yet still another example, U.S. Pat. No. 5,319,867 to Weber teaches an electrically conductive shoe insole for cushioning a user's foot and for transferring electrical charges from the wearer's foot to a conductive shoe. The shoe insole includes a cushioned layer which contains an electrically conductive material, and a fabric which is bonded to the top surface of the cushioned layer by a nonconductive adhesive. The fabric has a noncorrosive electrically conductive fiber interwoven therein. The adhesive is applied such that the electrically conductive fibers in the fabric contact the cushioned layer.

Still yet another example, U.S. Pat. No. 5,368,913 to Ortega teaches antistatic spunbonded nonwoven fabrics that include a plurality of substantially continuous electrically nonconductive filaments formed of a thermoplastic polymer, a plurality of electrically conductive filaments distributed among the electrically nonconductive filaments throughout the fabric, and a multiplicity of discrete bond sites bonding together the electrically nonconductive and the electrically conductive filaments to form a coherent fabric.

Finally yet still another example, U.S. Pat. No. 5,371,326 to Clearwaters-Dreager teaches an electrical conductor that includes a nonwoven material which has been impregnated with conductive ink to form electric circuits within the fiber of the material. The circuits conduct currents sufficient to drive a plurality of detachable integrated circuits which are actuated by the pressing of pressure-sensitive switches which touch two conductive fabric traces to complete a circuit.

It is apparent that numerous innovations for protective garments and fabrics have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly an object of the present invention is to provide a protective brassiere that avoids the disadvantages of the prior art.

Another object of the present invention is to provide a protective brassiere that is simple and inexpensive to manufacture.

Still another object of the present invention is to provide a protective brassiere that is simple to use.

Yet another object of the present invention is to provide a protective brassiere that minimizes radiation from electromagnetic interference, radio frequency interference, and microwave to sensitive breast tissue and related glandular areas.

Still yet another object of the present invention is to provide a protective brassiere that protects women in the workplace from the possible hazards of low-frequency electric and magnetic fields emanating from computer display terminals.

Briefly stated yet still another object of the present invention is to provide a protective brassiere that includes a generally concave-shaped right cup, a generally concave-shaped left cup, a generally elongated right side panel, a generally elongated left side panel, a removably mounted generally convex-shaped right cup protective insert of electrically conductive material, right cup protective insert mounting apparatus, a removably mounted generally convex-shaped left cup protective insert of electrically conductive material, left cup protective insert mounting apparatus, a removably mounted generally elongated right side panel protective insert of electrically conductive material, right side panel protective insert mounting apparatus, a removably mounted generally elongated left side panel protective insert of electrically conductive material, and left side panel protective insert mounting apparatus.

Still yet another object of the present invention is to provide a protective brassiere wherein the removably mounted generally convex-shaped right cup protective insert of electrically conductive material, the removably mounted generally convex-shaped left cup protective insert of electrically conductive material, the removably mounted generally elongated right side panel protective insert of electrically conductive material, and the removably mounted generally elongated left side panel protective insert of electrically conductive material are pliable and contain carbon.

Yet still another object of the present invention is to provide a protective brassiere wherein the generally concave-shaped right cup has a proximal side, a distal side, and an inner surface, Still yet another object of the present invention is to provide a protective brassiere wherein the generally concave-shaped right cup is constructed to overlie the right breast of a user.

Yet still another object of the present invention is to provide a protective brassiere wherein the generally concave-shaped left cup has a proximal side, a distal side, and an inner surface.

Still yet another object of the present invention is to provide a protective brassiere wherein the proximal side of the generally concave-shaped left cup is disposed at the proximal side of the generally concave-shaped right cup.

Yet still another object of the present invention is to provide a protective brassiere wherein the generally concave-shaped left cup is constructed to overlie the left breast of the user.

Still yet another object of the present invention is to provide a protective brassiere wherein the generally elongated right side panel has a proximal side, a distal side, and an inner surface.

Yet still another object of the present invention is to provide a protective brassiere wherein the proximal side of the generally elongated right side panel is disposed at the distal side of the generally concave-shaped right cup.

Still yet another object of the present invention is to provide a protective brassiere wherein the generally elongated right side panel is constructed to underlie the right arm pit of the user.

Yet still another object of the present invention is to provide a protective brassiere wherein the generally elongated left side panel has a proximal side, a distal side, and an inner surface.

Still yet another object of the present invention is to provide a protective brassiere wherein the proximal side of the generally elongated left side panel is disposed at the distal side of the generally concave-shaped left cup.

Yet still another object of the present invention is to provide a protective brassiere wherein the generally elongated left side panel is constructed to underlie the left armpit of the user.

Still yet another object of the present invention is to provide a protective brassiere wherein the removably mounted generally convex-shaped right cup protective insert of electrically conductive material has an outer surface and is removably mounted to the generally concave-shaped right cup, so that the right breast of the user is protected from radiation regardless of how minimal since radiation exposure is cumulative.

Yet still another object of the present invention is to provide a protective brassiere wherein the right cup protective insert mounting apparatus removably mounts the removably mounted generally convex-shaped right cup protective insert of electrically conductive material to the generally concave-shaped right cup.

Still yet another object of the present invention is to provide a protective brassiere wherein the removably mounted generally convex-shaped left cup protective insert of electrically conductive material has an outer surface and is removably mounted to the generally concave-shaped left cup, so that the left breast of the user is protected from radiation regardless of how minimal since radiation exposure is cumulative.

Yet still another object of the present invention is to provide a protective brassiere wherein the left cup protective insert mounting apparatus removably mounts the removably mounted generally convex-shaped left cup protective insert of electrically conductive material to the generally concave-shaped left cup.

Still yet another object of the present invention is to provide a protective brassiere wherein the removably mounted generally elongated right side panel protective insert of electrically conductive material has an outer surface and is removably mounted to the generally elongated right side panel, so that the right underarm area of the user is protected from radiation regardless of how minimal since radiation exposure is cumulative;

Yet still another object of the present invention is to provide a protective brassiere wherein the right side panel protective insert mounting apparatus removably mounts the removably mounted generally elongated right side panel protective insert of electrically conductive material to the generally elongated right side panel.

Still yet another object of the present invention is to provide a protective brassiere wherein the removably mounted generally elongated left side panel protective insert of electrically conductive material has an outer surface and is removably mounted to the generally elongated left side panel, so that the left underarm area of the user is protected from radiation regardless of how minimal since radiation exposure is cumulative.

Yet still another object of the present invention is to provide a protective brassiere wherein the left side panel protective insert mounting apparatus removably mounts the removably mounted generally elongated left side panel protective insert of electrically conductive material to the generally elongated left side panel.

Still yet another object of the present invention is to provide a protective brassiere wherein the generally concave-shaped right cup, the generally concave-shaped left cup, the generally elongated right side panel, and the generally elongated left side panel are integrally formed from a fabric.

Yet still another object of the present invention is to provide a protective brassiere wherein the removably mounted generally convex-shaped right cup protective insert portion of electrically conductive material has a shape selected from the group consisting of thin to function as a shield and breast-shaped to function as a shield and a filler pad for women who have undergone radical mastectomy surgery while further protecting against future metastasizing.

Still yet another object of the present invention is to provide a protective brassiere wherein the right cup protective insert mounting apparatus includes hook and loop fasteners, a part of the hook and loop fasteners is affixed to the inner surface of the generally concave-shaped right cup and a mating part of the hook and loop fasteners is affixed to the outer surface of the removably mounted generally convex-shaped right cup protective insert of electrically conductive material, so that said removably mounted generally convex-shaped right cup protective insert of electrically conductive material can be readily secured to, and readily removed from, said generally concave-shaped right cup.

Yet still another object of the present invention is to provide a protective brassiere wherein the removably mounted generally convex-shaped left cup protective insert portion of electrically conductive material has a shape selected from the group consisting of thin to function as a shield and breast-shaped to function as a shield and a filler pad for women who have undergone radical mastectomy surgery while further protecting against future metastasizing.

Still yet another object of the present invention is to provide a protective brassiere wherein the left cup protective insert mounting apparatus includes hook and loop fasteners, a part of the hook and loop fasteners is affixed to the inner surface of the generally concave-shaped left cup and a mating part of the hook and loop fasteners is affixed to the outer surface of the removably mounted generally convex-shaped left cup protective insert of electrically conductive material, so that said removably mounted generally convex-shaped left cup protective insert of electrically conductive material can be readily secured to, and readily removed from, said generally concave-shaped left cup.

Yet still another object of the present invention is to provide a protective brassiere wherein the right side panel protective insert mounting apparatus includes hook and loop fasteners, a part of the hook and loop fasteners is affixed to the inner surface of the generally elongated right side panel and a mating part of the hook and loop fasteners is affixed to the outer surface of the removably mounted generally elongated right side panel protective insert of electrically conductive material, so that said removably mounted generally elongated right side panel protective insert of electrically conductive material can be readily secured to, and readily removed from, said generally elongated right side panel.

Still yet another object of the present invention is to provide a protective brassiere wherein the left side panel protective insert mounting apparatus includes hook and loop fasteners, a part of the hook and loop fasteners is affixed to the inner surface of the generally elongated left side panel and a mating part of the hook and loop fasteners is affixed to the outer surface of the removably mounted generally elongated left side panel protective insert of electrically conductive material, so that said removably mounted generally elongated left side panel protective insert of electrically conductive material can be readily secured to, and readily removed from, said generally elongated left side panel.

Yet still another object of the present invention is to provide a protective brassiere that further includes protective brassiere fastening apparatus for removably securing the protective brassiere around the thoracic cage of the user.

Still yet another object of the present invention is to provide a protective brassiere wherein the protective brassiere fastening apparatus is disposed at the distal side of the generally elongated right side panel and at the distal side of the generally elongated left side panel.

Yet still another object of the present invention is to provide a protective brassiere wherein the protective brassiere fastening apparatus includes mating parts selected from the group consisting of clasp and hook and loop fasteners.

Still yet another object of the present invention is to provide a protective brassiere that further includes a right shoulder strap that spans from the generally concave-shaped right cup to the generally elongated right side panel and a left shoulder strap that spans from the generally concave-shaped left cup to the generally elongated left side panel.

Yet still another object of the present invention is to provide a protective brassiere wherein the right cup protective insert mounting means includes a generally circular pocket flap that is disposed on the inner surface of the generally concave right cup and together with the inner surface of the generally concave right cup form a generally circular pocket for receiving the removably mounted generally convex-shaped right cup protective insert of electrically conductive material, so that the removably mounted generally convex-shaped right cup protective insert of electrically conductive material can be readily secured to, and readily removed from, the generally concave-shaped right cup.

Still yet another object of the present invention is to provide a protective brassiere wherein the left cup protective insert mounting means includes a generally circular pocket flap that is disposed on the inner surface of the generally concave left cup and together with the inner surface of the generally concave left cup form a generally circular pocket for receiving the removably mounted generally convex-shaped left cup protective insert of electrically conductive material, so that the removably mounted generally convex-shaped left cup protective insert of electrically conductive material can be readily secured to, and readily removed from, the generally concave-shaped left cup.

Yet still another object of the present invention is to provide a protective brassiere wherein the right side panel protective insert mounting means includes a generally elongated pocket flap that is disposed on the inner surface of the generally elongated right side panel and together with the inner surface of the generally elongated right side panel form a generally elongated pocket for receiving the removably mounted generally elongated right side panel protective insert of electrically conductive material, so that the removably mounted generally elongated right side panel protective insert of electrically conductive material can be readily secured to, and readily removed from, the generally elongated right side panel.

Finally still yet another object of the present invention is to provide a protective brassiere wherein the left side panel protective insert mounting means includes a generally elongated pocket flap that is disposed on the inner surface of the generally elongated left side panel and together with the inner surface of the generally elongated left side panel form a generally elongated pocket for receiving the removably mounted generally elongated left side panel protective insert of electrically conductive material, so that the removably mounted generally elongated left side panel protective insert of electrically conductive material can be readily secured to, and readily removed from, the generally elongated left side panel.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Preferred Embodiment

Figure 1:
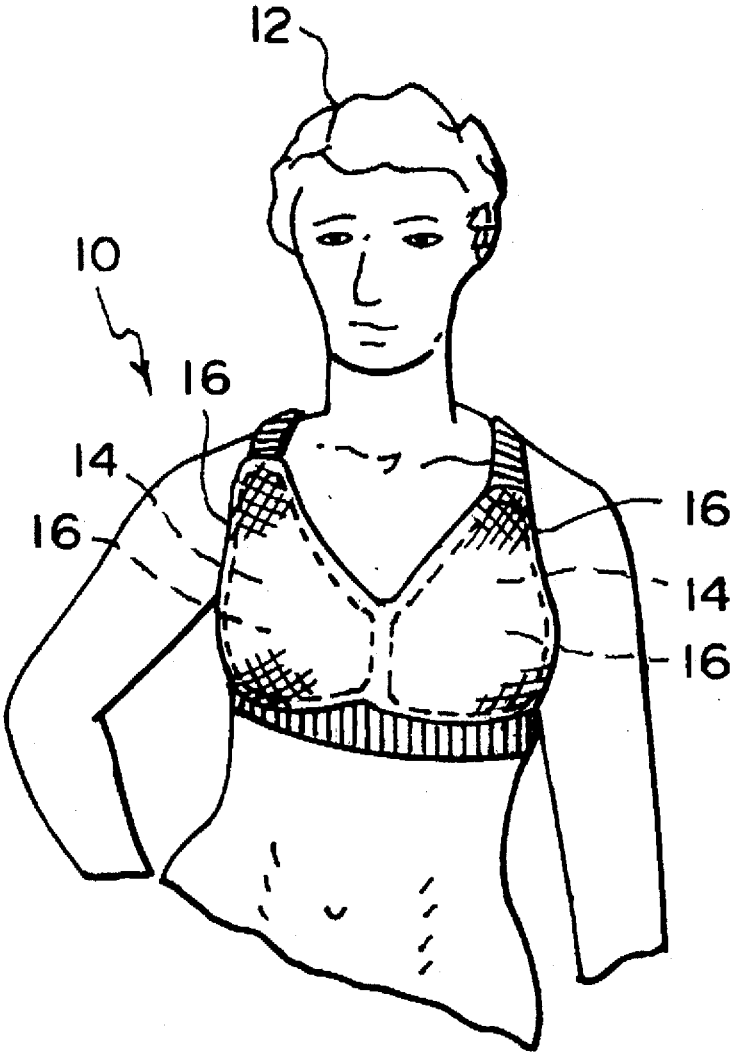
FIG. 1 is a perspective view of the preferred embodiment and the alternate embodiment of the protective brassiere with removably mounted inserts of electrically conductive material of the present invention being worn by a women and protecting the breast tissue and related glandular areas.

10 protective brassiere with removably mounted inserts of electrically conductive pliable carbon material of the present invention

12 women

14 women breast tissue

16 related women glandular areas

18 brassiere portion

20 brassiere portion generally concave right cup

22 brassiere portion right cup proximal side

24 brassiere portion right cup distal side

26 brassiere portion right cup inner surface

27 part of at least one brassiere portion right cup inner surface hook and loop fasteners

28 brassiere portion generally concave left cup

30 brassiere portion left cup proximal side

32 brassiere portion left cup distal side

34 brassiere portion left cup inner surface

35 part of at least one brassiere portion left cup inner surface hook and loop fasteners

36 brassiere portion generally elongated right side panel

38 brassiere portion right side panel proximal side

40 brassiere portion right side panel distal side

42 brassiere portion right side panel inner surface

44 part of at least one brassiere portion right side panel inner surface hook and loop fasteners

45 part of a brassiere portion right side panel distal side conventional fastener

46 brassiere portion generally elongated left side panel

48 brassiere portion left side panel proximal side

50 brassiere portion left side panel distal side

52 brassiere portion left side panel inner surface

54 part of at least one brassiere portion left side panel inner surface hook and loop fasteners

55 part of a brassiere portion left side panel distal side conventional fastener

56 brassiere portion right shoulder strap

58 brassiere portion left shoulder strap

60 removably mounted generally convex right cup protective insert portion of electrically conductive pliable carbon material

62 right cup protective insert portion outer surface

64 part of at least one right cup protective insert portion outer surface hook and loop fasteners

66 removably mounted generally convex left cup protective insert portion of electrically conductive pliable carbon material

68 left cup protective insert portion outer surface

70 part of at least one left cup protective insert portion outer surface hook and loop fasteners

72 removably mounted generally elongated right side panel protective insert portion of electrically conductive pliable carbon material

74 right side panel protective insert portion outer surface

76 part of at least one right side panel protective insert portion outer surface hook and loop fasteners

78 removably mounted generally elongated left side panel protective insert portion of electrically conductive pliable carbon material

80 left side panel protective insert portion outer surface

82 part of at least one left side panel protective insert portion outer surface hook and loop fasteners Alternate Embodiment

110 protective brassiere with removably mounted protective inserts of electrically conductive pliable carbon material of the present invention

118 brassiere portion

120 brassiere portion generally concave right cup

122 brassiere portion right cup proximal side

124 brassiere portion right cup distal side

126 brassiere portion right cup inner surface

127 brassiere portion right cup inner surface generally circular pocket flap

128 brassiere portion right cup inner surface generally circular pocket

129 brassiere portion generally concave left cup

130 brassiere portion left cup proximal side

132 brassiere portion left cup distal side

134 brassiere portion left cup inner surface

135 brassiere portion left cup inner surface generally circular pocket flap

136 brassiere portion left cup inner surface generally circular pocket

137 brassiere portion generally elongated right side panel

138 brassiere portion right side panel proximal side

140 brassiere portion right side panel distal side

142 brassiere portion right side panel inner surface

143 brassiere portion right side panel inner surface generally elongated pocket flap

145 brassiere portion right side panel inner surface generally elongated pocket

146 part of a brassiere portion right side panel distal side conventional fastener

147 brassiere portion generally elongated left side panel

148 brassiere portion left side panel proximal side

150 brassiere portion left side panel distal side

152 brassiere portion left side panel inner surface

153 brassiere portion left side panel inner surface generally elongated pocket flap

155 brassiere portion left side panel inner surface generally elongated pocket

156 part of a brassiere portion left side panel distal side conventional fastener

157 brassiere portion right shoulder strap

158 brassiere portion left shoulder strap

160 removably mounted generally convex right cup protective insert portion of electrically conductive pliable carbon material

166 removably mounted generally convex left cup protective insert portion of electrically conductive pliable carbon material

172 removably mounted generally elongated right side panel insert portion of electrically conductive pliable carbon material

178 removably mounted generally elongated left side panel insert portion of electrically conductive pliable carbon material

DETAILED DESCRIPTION OF THE PREFERRED EMBODIMENT

Referring now to the figures in which like numerals indicate like parts, and particularly to FIG. 1, the protective brassiere with removably mounted inserts of electrically conductive pliable carbon material of the present invention is shown generally at 10 being worn by a women 12 and protecting the women breast tissue 14 and related women glandular areas 16, such as mammary and lymph but not limited to that. The protective brassiere with removably mounted inserts of electrically conductive pliable carbon material 10 is available in all cup and chest sizes.

Figure 2:
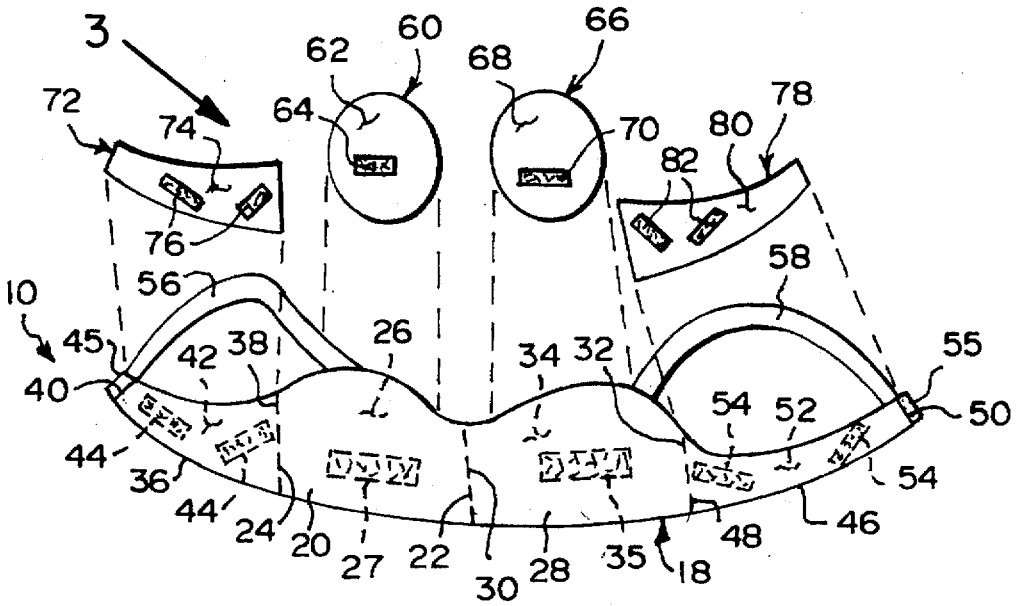
FIG. 2 is an exploded front perspective view of the preferred embodiment of the protective brassiere with removably mounted inserts of electrically conductive material of the present invention shown in FIG. 1.
Figure 3:
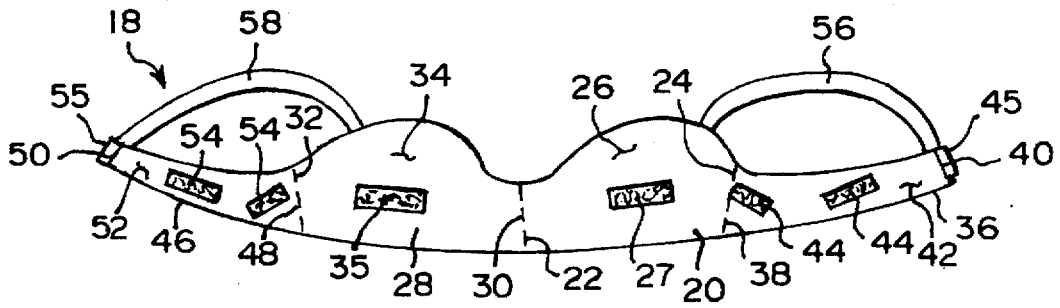
FIG. 3 is a rear perspective view taken in the direction of arrow 3 in FIG. 2 of the brassiere portion of the preferred embodiment of the protective brassiere with removably mounted inserts of electrically conductive material of the present invention.
Figure 4:
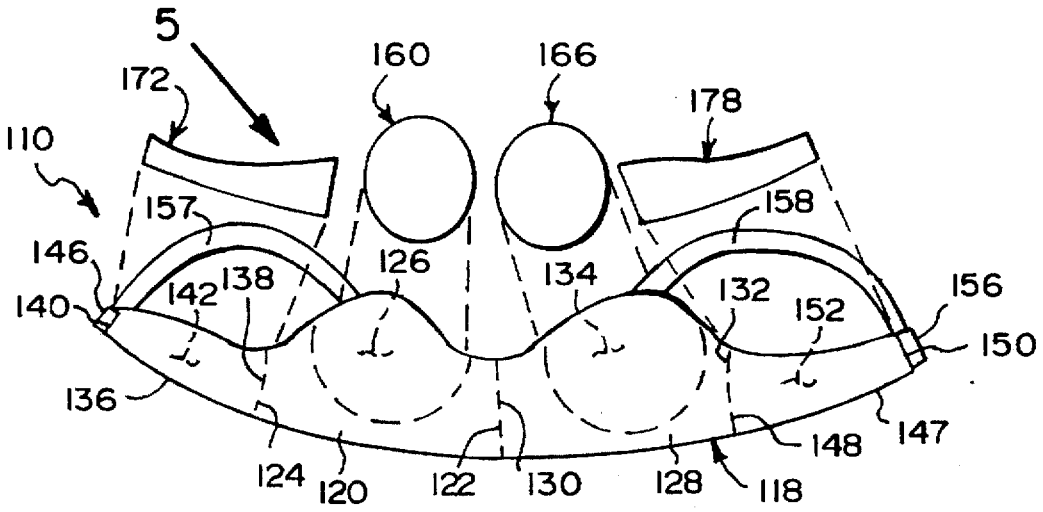
FIG. 4 is an exploded front perspective view of the alternate embodiment of the protective brassiere with removably mounted inserts of electrically conductive material of the present invention shown in FIG. 1.
Figure 5:
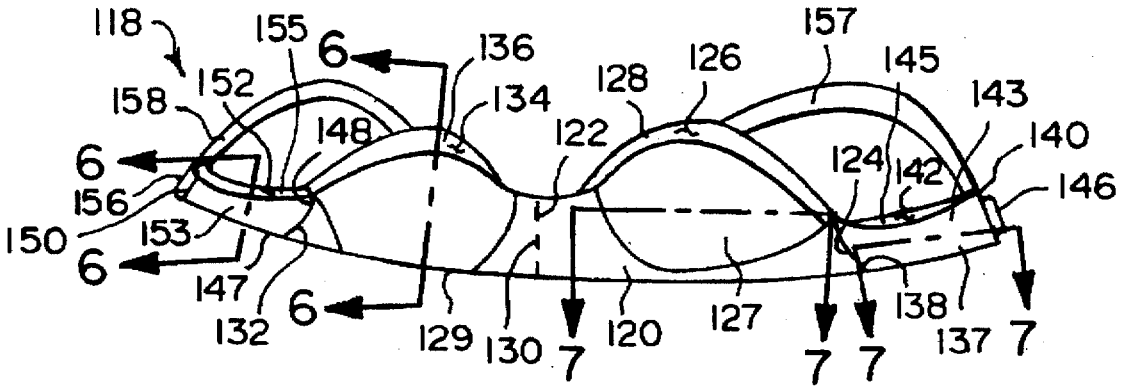
FIG. 5 is a rear perspective view taken in the direction of arrow 5 in FIG. 4 of brassiere portion of the alternate embodiment of the protective brassiere with removably mounted inserts of electrically conductive material of the present invention.
Figure 6:
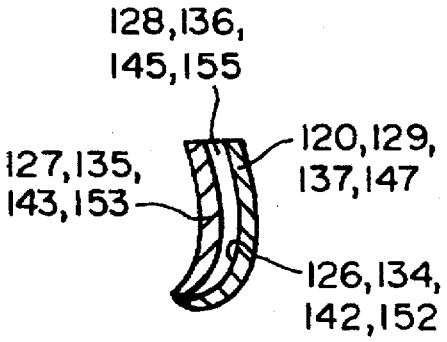
FIG. 6 is an enlarged side elevational cross sectional view taken on line 6—6 in FIG. 5 of the alternate embodiment of the protective brassiere with removably mounted inserts of electrically conductive material of the present invention illustrating the general lateral cross sectional configuration of the pockets of the cups and of the general lateral cross sectional configuration of the pockets of the side panels.
Figure 7:
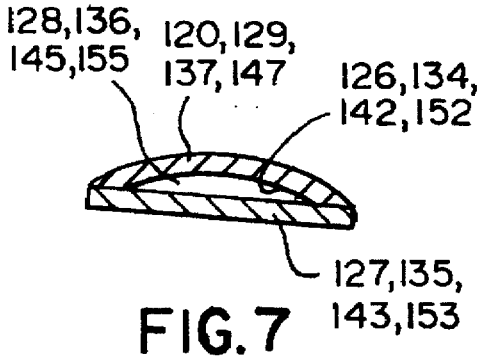
FIG. 7 is an enlarged cross sectional view taken on line 7—7 in FIG. 5 of the alternate embodiment of the protective brassiere with removably mounted inserts of electrically conductive material of the present invention illustrating the general longitudinal cross sectional configuration of the pockets of the cups and the general longitudinal cross sectional configuration of the pockets of the side panels.

The configuration of the preferred embodiment of the protective brassiere with removably mounted inserts of electrically conductive pliable carbon material 10 can best be seen in FIGS. 2 and 3, and as such, will be discussed with reference thereto.

The protective brassiere with removably mounted inserts of electrically conductive pliable carbon material 10 includes a brassiere portion 18. The brassiere portion 18 is a fabric and is flexibly constructed to be worn and conform to the thoracic cage of the user.

The brassiere portion 18 has a brassiere portion generally concave right cup 20 with a brassiere portion right cup proximal side 22, a brassiere portion right cup distal side 24, a brassiere portion right cup inner surface 26, and a part of at least one brassiere portion right cup inner surface hook and loop fasteners 27 that is disposed on the brassiere portion right cup inner surface 26 of the brassiere portion generally concave right cup 20 of the brassiere portion 18, and which is commonly known under the trademark VELCRO(™). The brassiere portion generally concave right cup 20 of the brassiere portion 18 is constructed and disposed to overlie the right breast of the user.

The brassiere portion 18 further has a brassiere portion generally concave left cup 28 with a brassiere portion left cup proximal side 30, a brassiere portion left cup distal side 32, a brassiere portion left cup inner surface 34, and a part of at least one brassiere portion left cup inner surface hook and loop fasteners 35 that is disposed on the brassiere portion left cup inner surface 34 of the brassiere portion generally concave left cup 28 of the brassiere portion 18, and which is commonly known under the trademark VELCRO (™). The brassiere portion generally concave left cup 28 of the brassiere portion 18 is constructed and disposed to overlie the left breast of the user.

The brassiere portion left cup proximal side 30 of the brassiere portion generally concave left cup 28 of the brassiere portion 18 is disposed at the brassiere portion right cup proximal side 22 of the brassiere portion generally concave right cup 20 of the of the brassiere portion 18, and may be integrally formed therewith but is not limited to that.

The brassiere portion 18 further has a brassiere portion generally elongated right side panel 36 with a brassiere portion right side panel proximal side 38, a brassiere portion right side panel distal side 40, a brassiere portion right side panel inner surface 42, and a part of at least one brassiere portion right side panel inner surface hook and loop fasteners 44 that is disposed on the brassiere portion right side panel inner surface 42 of the brassiere portion generally elongated right side panel 36 of the brassiere portion 18, and which is commonly known under the trademark VELCRO (™).

The brassiere portion right side panel proximal side 38 of the brassiere portion generally elongated right side panel 36 of the brassiere portion 18 is disposed at the brassiere portion right cup distal side 24 of the brassiere portion generally concave right cup 20 of the brassiere portion 18, and may be integrally formed therewith but is not limited to that. The brassiere portion generally elongated right side panel 36 is constructed and disposed to underlie the right arm pit of the user.

A part of a brassiere portion right side panel distal side conventional fastener 45 is disposed at the brassiere portion right side panel distal side 40 of the brassiere portion generally elongated right side panel 36 of the brassiere portion 18 and may be of any conventional type, such as but not limited to a clasp or a part of hook and loop fasteners which is commonly known under the trademark VELCRO (™).

The brassiere portion 18 further has a brassiere portion generally elongated left side panel 46 with a brassiere portion left side panel proximal side 48, a brassiere portion left side panel distal side 50, a brassiere portion left side panel inner surface 52, and a part of at least one brassiere portion left side panel inner surface hook and loop fasteners 54 that is disposed on the brassiere portion left side panel inner surface 52 of the brassiere portion generally elongated left side panel 46 of the brassiere portion 18, and which is commonly known under the trademark VELCRO(™).

The brassiere portion left side panel proximal side 48 of the brassiere portion generally elongated left side panel 46 of the brassiere portion 18 is disposed at the brassiere portion left cup distal side 32 of the brassiere portion generally concave left cup 28 of the brassiere portion 18, and may be integrally formed therewith but is not limited to that. The brassiere portion generally elongated left side panel 46 is constructed and disposed to underlie the left arm pit of the user.

A part of a brassiere portion left side panel distal side conventional fastener 55 is disposed at the brassiere portion left side panel distal side 50 of the brassiere portion generally elongated left side panel 46 of the brassiere portion 18 and may be of any conventional type, such as but not limited to a clasp or a part of hook and loop fasteners which is commonly known under the trademark VELCRO(™), and mates with the part of the brassiere portion right side panel distal side conventional fastener 45 of the brassiere portion right side panel distal side 40 of the brassiere portion generally elongated right side panel 36 of the brassiere portion 18, so that the brassiere portion 18 can be secured around the thoracic cage of the user.

The brassiere portion 18 further has a brassiere portion right shoulder strap 56 that spans from the brassiere portion generally concave right cup 20 of the brassiere portion 18 to the brassiere portion generally elongated right side panel 36 of the brassiere portion 18 and a brassiere portion left shoulder strap 58 that spans from the brassiere portion generally concave left cup 28 of the brassiere portion 18 to the brassiere portion generally elongated left side panel 46 of the brassiere portion 18.

The brassiere portion right shoulder strap 56 of the brassiere portion 18 and the brassiere portion left shoulder strap 58 of the brassiere portion 18 are optional and are not required when the brassiere portion 18 is strapless.

The protective brassiere with removably mounted inserts of electrically conductive pliable carbon material 10 further includes a removably mounted generally convex right cup protective insert portion of electrically conductive pliable carbon material 60 with a right cup protective insert portion outer surface 62, and a part of at least one right cup protective insert portion outer surface hook and loop fasteners 64 that is disposed on the right cup protective insert portion outer surface 62 of the removably mounted generally convex right cup protective insert portion of electrically conductive pliable carbon material 60, and which is commonly known under the trademark VELCRO(™). The removably mounted generally convex right cup protective insert portion of electrically conductive pliable carbon material 60 protects the right breast of the user from radiation regardless of how minimal since radiation exposure is cumulative.

The removably mounted generally convex right cup protective insert portion of electrically conductive pliable carbon material 60 can be thin and function as a shield or can be breast-shaped and function as a shield and a filler pad for women who have undergone radical mastectomy surgery while further protecting against future metastasizing.

The part of the at least one right cup protective insert portion outer surface hook and loop fasteners 64 of the right cup protective insert portion outer surface 62 of the removably mounted generally convex right cup protective insert portion of electrically conductive pliable carbon material 60 is complementary to, and mates with, the part of the at least one brassiere portion right cup inner surface hook and loop fasteners 27 of the brassiere portion right cup inner surface 26 of the brassiere portion generally concave right cup 20 of the brassiere portion 18, so that the removably mounted generally convex right cup protective insert portion of electrically conductive pliable carbon material 60 is readily secured to, and readily removed from, the brassiere portion 18.

The protective brassiere with removably mounted protective inserts of electrically conductive pliable carbon material 10 further includes a removably mounted generally convex left cup protective insert portion of electrically conductive pliable carbon material 66 with a left cup protective insert portion outer surface 68, and a part of at least one left cup protective insert portion outer surface hook and loop fasteners 70 that is disposed on the left cup protective insert portion outer surface 68 of the removably mounted generally convex left cup protective insert portion of electrically conductive pliable carbon material 66, and which is commonly known under the trademark VELCRO(™). The removably mounted generally convex left cup protective insert portion of electrically conductive pliable carbon material 66 protects the left breast of the user from radiation regardless of how minimal since radiation exposure is cumulative.

The removably mounted generally convex left cup protective insert portion of electrically conductive pliable carbon material 66 can be thin and function as a shield or can be breast-shaped and function as a shield and a filler pad for women who have undergone radical mastectomy surgery while further protecting against future metastasizing.

The part of the at least one left cup protective insert portion outer surface hook and loop fasteners 70 of the left cup protective insert portion outer surface 68 of the removably mounted generally convex left cup protective insert portion of electrically conductive pliable carbon material 66 is complementary to, and mates with, the part of the at least one brassiere portion left cup inner surface hook and loop fasteners 35 of the brassiere portion left cup inner surface 34 of the brassiere portion generally concave left cup 28 of the brassiere portion 18, so that the removably mounted generally convex left cup protective insert portion of electrically conductive pliable carbon material 66 is readily secured to, and readily removed from, the brassiere portion 18.

The protective brassiere with removably mounted inserts of electrically conductive pliable carbon material 10 further includes a removably mounted generally elongated right side panel protective insert portion of electrically conductive pliable carbon material 72 with a right side panel protective insert portion outer surface 74, and a part of at least one right side panel protective insert portion outer surface hook and loop fasteners 76 that is disposed on the right side panel protective insert portion outer surface 74 of the removably mounted generally elongated right side panel protective insert portion of electrically conductive pliable carbon material 72, and which is commonly known under the trademark VELCRO(™). The removably mounted generally elongated right side panel protective insert portion of electrically conductive pliable carbon material 72 protects the right underarm area of the user from radiation regardless of how minimal since radiation exposure is cumulative.

The part of the at least one right side panel protective insert portion outer surface hook and loop fasteners 76 of the right side panel protective insert portion outer surface 74 of the removably mounted generally elongated right side panel protective insert portion of electrically conductive pliable carbon material 72 is complementary to, and mates with, the part of the at least one brassiere portion right side panel inner surface hook and loop fasteners 44 of the brassiere portion right side panel inner surface 42 of the brassiere portion generally elongated right side panel 36 of the brassiere portion 18, so that the removably mounted generally elongated right side panel protective insert portion of electrically conductive pliable carbon material 72 is readily secured to, and readily removed from, the brassiere portion 18.

The protective brassiere with removably mounted inserts of electrically conductive pliable carbon material 10 further includes a removably mounted generally elongated left side panel protective insert portion of electrically conductive pliable carbon material 78 with a left side panel protective insert portion outer surface 80, and a part of at least one left side panel protective insert portion outer surface hook and loop fasteners 82 that is disposed on the left side panel protective insert portion outer surface 80 of the removably mounted generally elongated left side panel protective insert portion of electrically conductive pliable carbon material 78, and which is commonly known under the trademark VELCRO(™). The removably mounted generally elongated left side panel protective insert portion of electrically conductive pliable carbon material 78 protects the left underarm area of the user from radiation regardless of how minimal since radiation exposure is cumulative.

The part of the at least one left side panel protective insert portion outer surface hook and loop fasteners 82 of the left side panel protective insert portion outer surface 80 of the removably mounted generally elongated left side panel protective insert portion of electrically conductive pliable carbon material 78 is complementary to, and mates with, the part of the at least one brassiere portion left side panel inner surface hook and loop fasteners 54 of the brassiere portion left side panel inner surface 52 of the brassiere portion generally elongated left side panel 46 of the brassiere portion 18, so that the removably mounted generally elongated left side panel protective insert portion of electrically conductive pliable carbon material 78 is readily secured to, and readily removed from, the brassiere portion 18.

The configuration of the alternate embodiment of the protective brassiere with removably mounted inserts of electrically conductive pliable carbon material 110 can best be seen in FIGS. 4 through 7, and as such, will be discussed with reference thereto.

The protective brassiere with removably mounted protective inserts of electrically conductive pliable carbon material 110 includes a brassiere portion 118. The brassiere portion 118 is a fabric and is flexibly constructed to be worn and conform to the thoracic cage of the user.

The brassiere portion 118 has a brassiere portion generally concave right cup 120 with a brassiere portion right cup proximal side 122, a brassiere portion right cup distal side 124, a brassiere portion right cup inner surface 126, and a brassiere portion right cup inner surface generally circular pocket flap 127 that is disposed on the brassiere portion right cup inner surface 126 of the brassiere portion generally concave right cup 120 of the brassiere portion 118 and together with the brassiere portion right cup inner surface 126 of the brassiere portion generally concave right cup 120 of the brassiere portion 118 form a brassiere portion right cup inner surface generally circular pocket 128. The brassiere portion generally concave right cup 120 is constructed and disposed to overlie the right breast of the user.

The brassiere portion 118 further has a brassiere portion generally concave left cup 129 with a brassiere portion left cup proximal side 130, a brassiere portion left cup distal side 132, a brassiere portion left cup inner surface 134, and a brassiere portion left cup inner surface generally circular pocket flap 135 that is disposed on the brassiere portion left cup inner surface 134 of the brassiere portion generally concave left cup 129 of the brassiere portion 118 and together with the brassiere portion left cup inner surface 134 of the brassiere portion generally concave left cup 129 of the brassiere portion 118 form a brassiere portion left cup inner surface generally circular pocket 136. The brassiere portion generally concave left cup 129 is constructed and disposed to overlie the left breast of the user.

The brassiere portion left cup proximal side 130 of the brassiere portion generally concave left cup 129 of the brassiere portion 118 is disposed at the brassiere portion right cup proximal side 122 of the brassiere portion generally concave right cup 120 of the of the brassiere portion 118, and may be integrally formed therewith but is not limited to that.

The brassiere portion 118 further has a brassiere portion generally elongated right side panel 137 with a brassiere portion right side panel proximal side 138, a brassiere portion right side panel distal side 140, a brassiere portion right side panel inner surface 142, and a brassiere portion right side panel inner surface generally elongated pocket flap 143 that is disposed on the brassiere portion right side panel inner surface 142 of the brassiere portion generally elongated right side panel 137 of the brassiere portion 118 and together with the brassiere portion right side panel inner surface 142 of the brassiere portion generally elongated right side panel 137 of the brassiere portion 118 form a brassiere portion right side panel inner surface generally elongated pocket 145.

The brassiere portion right side panel proximal side 138 of the brassiere portion generally elongated right side panel 137 of the brassiere portion 118 is disposed at the brassiere portion right cup distal side 124 of the brassiere portion generally concave right cup 120 of the brassiere portion 118, and may be integrally formed therewith but is not limited to that.

A part of a brassiere portion right side panel distal side conventional fastener 146 is disposed at the brassiere portion right side panel distal side 140 of the brassiere portion generally elongated right side panel 137 of the brassiere portion 118, and may be of any conventional type, such as but not limited to a clasp or a part of hook and loop fasteners which is commonly known under the trademark VELCRO (™).

The brassiere portion 118 further has a brassiere portion generally elongated left side panel 147 with a brassiere portion left side panel proximal side 148, a brassiere portion left side panel distal side 150, a brassiere portion left side panel inner surface 152, and a brassiere portion left side panel inner surface generally elongated pocket flap 153 that is disposed on the brassiere portion left side panel inner surface 152 of the brassiere portion generally elongated left side panel 147 of the brassiere portion 118 and together with the brassiere portion left side panel inner surface 152 of the brassiere portion generally elongated left side panel 147 of the brassiere portion 118 form a brassiere portion left side panel inner surface generally elongated pocket 155.

The brassiere portion 118 can be two overlaid layers of fabric, strategically stitched, so as to form the brassiere portion right cup inner surface generally circular pocket 128 of the brassiere portion right cup inner surface 126 of the brassiere portion right cup 120 of the brassiere portion 118, the brassiere portion left cup inner surface generally circular pocket 136 of the brassiere portion left cup inner surface 134 of the brassiere portion left cup 129 of the brassiere portion 118, the brassiere portion right side panel inner surface generally elongated pocket 145 of the brassiere portion right side panel inner surface 142 of the brassiere portion generally elongated right side panel 137 of the brassiere portion 118, and the brassiere portion left side panel inner surface generally elongated pocket 155 of the brassiere portion left side panel inner surface 152 of the brassiere portion generally elongated left side panel 147 of the brassiere portion 118.

The brassiere portion left side panel proximal side 148 of the brassiere portion generally elongated left side panel 147 of the brassiere portion 118 is disposed at the brassiere portion left cup distal side 132 of the brassiere portion generally concave left cup 129 of the brassiere portion 118, and may be integrally formed therewith but is not limited to that.

A part of a brassiere portion left side panel distal side conventional fastener 156 is disposed at the brassiere portion left side panel distal side 150 of the brassiere portion generally elongated left side panel 147 of the brassiere portion 118, and may be of any conventional type, such as but not limited to a clasp or a part of hook and loop fasteners which is commonly known under the trademark VELCRO (™), and mates with the part of the brassiere portion right side panel distal side conventional fastener 146 of the brassiere portion right side panel distal side 140 of the brassiere portion generally elongated right side panel 137 of the brassiere portion 118, so that the brassiere portion 118 can be secured around the thoracic cage of the user.

The brassiere portion 118 further has a brassiere portion right shoulder strap 157 that spans from the brassiere portion generally concave right cup 120 of the brassiere portion 118 to the brassiere portion generally elongated right side panel 137 of the brassiere portion 118 and a brassiere portion left shoulder strap 158 that spans from the brassiere portion generally concave left cup 129 of the brassiere portion 118 to the brassiere portion generally elongated left side panel 147 of the brassiere portion 118.

The brassiere portion right shoulder strap 157 of the brassiere portion 118 and the brassiere portion left shoulder strap 158 of the brassiere portion 118 are optional and not required when the brassiere portion 118 is strapless.

The protective brassiere with removably mounted inserts of electrically conductive pliable carbon material 110 further includes a removably mounted generally convex right cup protective insert portion of electrically conductive pliable carbon material 160. The removably mounted generally convex right cup protective insert portion of electrically conductive pliable carbon material 160 can be thin and function as a shield or can be breast-shaped and function as a shield and a filler pad for women who have undergone radical mastectomy surgery while further protecting against future metastasizing.

The removably mounted generally convex right cup protective insert portion of electrically conductive pliable carbon material 160 is removably mounted in the brassiere portion right cup inner surface generally circular pocket 128 of the brassiere portion right cup inner surface 126 of the brassiere portion right cup 120 of the brassiere portion 118, so that the removably mounted generally convex right cup protective insert portion of electrically conductive pliable carbon material 160 is readily inserted into, and readily removed from, the brassiere portion 118.

The protective brassiere with removably mounted inserts of electrically conductive pliable carbon material 110 further includes a removably mounted generally convex left cup protective insert portion of electrically conductive pliable carbon material 166. The removably mounted generally convex left cup protective insert portion of electrically conductive pliable carbon material 166 can be thin and function as a shield or can be breast-shaped and function as a shield and a filler pad for women who have undergone radical mastectomy surgery while further protecting against future metastasizing.

The removably mounted generally convex left cup protective insert portion of electrically conductive pliable carbon material 166 is removably mounted in the brassiere portion left cup inner surface generally circular pocket 136 of the brassiere portion left cup inner surface 134 of the brassiere portion left cup 129 of the brassiere portion 118, so that the removably mounted generally convex left cup protective insert portion of electrically conductive pliable carbon material 166 is readily inserted into, and readily removed from, the brassiere portion 118.

The protective brassiere with removably mounted inserts of electrically conductive pliable carbon material 110 further includes a removably mounted generally elongated right side panel insert portion of electrically conductive pliable carbon material 172.

The removably mounted generally elongated right side panel insert portion of electrically conductive pliable carbon material 172 is removably mounted in the brassiere portion right side panel inner surface generally elongated pocket 145 of the brassiere portion right side panel inner surface 142 of the brassiere portion generally elongated right side panel 137 of the brassiere portion 118, so that the removably mounted generally elongated right side panel insert portion of electrically conductive pliable carbon material 172 is readily inserted into, and readily removed from, the brassiere portion 118.

The protective brassiere with removably mounted inserts of electrically conductive pliable carbon material 110 further includes a removably mounted generally elongated left side panel insert portion of electrically conductive pliable carbon material 178.

The removably mounted generally elongated left side panel insert portion of electrically conductive pliable carbon material 178 is removably mounted in the brassiere portion left side panel inner surface generally elongated pocket 155 of the brassiere portion left side panel inner surface 152 of the brassiere portion generally elongated left side panel 147 of the brassiere portion 118, so that the removably mounted generally elongated left side panel insert portion of electrically conductive pliable carbon material 178 is readily inserted into, and readily removed from, the brassiere portion 118.

It will be understood that each of the elements described above, or two or more together, may also find a useful application in other types of constructions differing from the types described above.

While the invention has been illustrated and described as embodied in a protective brassiere with removably mounted inserts of electrically conductive material, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A protective brassiere, comprising:

a) a generally concave-shaped right cup having a proximal side, a distal side, and an inner surface; said generally concave-shaped right cup being constructed to overlie the right breast of a user;

b) a generally concave-shaped left cup having a proximal side, a distal side, and an inner surface; said proximal side of said generally concave-shaped left cup being disposed at said proximal side of said generally concave-shaped right cup; said generally concave-shaped left cup being constructed to overlie the left breast of the user;

c) a generally elongated right side panel having a proximal side, a distal side, and an inner surface; said proximal side of said generally elongated right side panel being disposed at said distal side of said generally concave-shaped right cup; said generally elongated right side panel being constructed to underlie the right arm pit of the user;

d) a generally elongated left side panel having a proximal side, a distal side, and an inner surface; said proximal side of said generally elongated left side panel being disposed at said distal side of said generally concave-shaped left cup; said generally elongated left side panel being constructed to underlie the left arm pit of the user;

e) a removably mounted generally convex-shaped right cup protective insert of electrically conductive material having an outer surface and being removably mounted to said generally concave-shaped right cup, so that the right breast of the user is protected from radiation regardless of how minimal since radiation exposure is cumulative; said removably mounted generally convex-shaped right cup protective insert of electrically conductive material being pliable and containing carbon;

f) right cup protective insert mounting means for removably mounting said removably mounted generally convex-shaped right cup protective insert of electrically conductive material to said generally concave-shaped right cup;

g) a removably mounted generally convex-shaped left cup protective insert of electrically conductive material having an outer surface and being removably mounted to said generally concave-shaped left cup, so that the left breast of the user is protected from radiation regardless of how minimal since radiation exposure is cumulative; said removably mounted generally convex-shaped left cup protective insert of electrically conductive material being pliable and containing carbon;

h) left cup protective insert mounting means for removably mounting said removably mounted generally convex-shaped left cup protective insert of electrically conductive material to said generally concave-shaped left cup;

I) a removably mounted generally elongated right side panel protective insert of electrically conductive material having an outer surface and being removably mounted to said generally elongated right side panel, so that the right underarm area of the user is protected from radiation regardless of how minimal since radiation exposure is cumulative; said removably mounted generally elongated right side panel protective insert of electrically conductive material being pliable and containing carbon;

j) right side panel protective insert mounting means for removably mounting said removably mounted generally elongated right side panel protective insert of electrically conductive material to said generally elongated right side panel;

k) a removably mounted generally elongated left side panel protective insert of electrically conductive material having an outer surface and being removably mounted to said generally elongated left side panel, so that the left underarm area of the user is protected from radiation regardless of how minimal since radiation exposure is cumulative; said removably mounted generally elongated left side panel protective insert of electrically conductive material being pliable land containing carbon; and l) left side panel protective insert mounting means for removably mounting said removably mounted generally elongated left side panel protective insert of electrically conductive material to said generally elongated left side panel.

2. The brassiere as defined in claim 1, wherein said generally concave-shaped right cup, said generally concave-shaped left cup, said generally elongated right side panel, and said generally elongated left side panel are integrally formed from at least a first layer of fabric.

3. The brassiere as defined in claim 1, wherein said removably mounted generally convex-shaped right cup protective insert portion of electrically conductive material is thin functioning as a shield and configured generally in the shape of a wearer's breast to function as a shield aria a filler pad for women who have undergone radical mastectomy surgery while further protecting against future metastasizing.

4. The brassiere as defined in claim 1, wherein said right cup protective insert mounting means includes hook and loop fasteners, a part of said hook and loop fasteners is affixed to said inner surface of said generally concave-shaped right cup and a mating part of said hook and loop fasteners is affixed to said outer surface of said removably mounted generally convex-shaped right cup protective insert of electrically conductive material, so that said removably mounted generally convex-shaped right cup protective insert of electrically conductive material can be readily secured to, and readily removed from, said generally concave-shaped right cup.

5. The brassiere as defined in claim 1, wherein said removably mounted generally convex-shaped left cup protective insert portion of electrically conductive material is thin functioning as a shield and configured generally in the shape of a wearer's breast to function as a shield and a filler pad for women who have undergone radical mastectomy surgery while further protecting against future metastasizing.

6. The brassiere as defined in claim 1, wherein said left cup protective insert mounting means includes hook and loop fasteners, a part of said hook and loop fasteners is affixed to said inner surface of said generally concave-shaped left cup and a mating part of said hook and loop fasteners is affixed to said outer surface of said removably mounted generally convex-shaped left cup protective insert of electrically conductive material, so that said removably mounted generally convex-shaped left cup protective insert of electrically conductive material can be readily secured to, and readily removed from, said generally concave-shaped left cup.

7. The brassiere as defined in claim 1, wherein said right side panel protective insert mounting means includes hook and loop fasteners, a part of said hook and loop fasteners is affixed to said inner surface of said generally elongated right side panel and a mating part of said hook and loop fasteners is affixed to said outer surface of said removably mounted generally elongated right side panel protective insert of electrically conductive material, so that said removably mounted generally elongated right side panel protective insert of electrically conductive material can be readily secured to, and readily removed from, said generally elongated right side panel.

8. The brassiere as defined in claim 1, wherein said left side panel protective insert mounting means includes hook and loop fasteners, a part of said hook and loop fasteners is affixed to said inner surface of said generally elongated left side panel and a mating part of said hook and loop fasteners is affixed to said outer surface of said removably mounted generally elongated left side panel protective insert of electrically conductive material, so that said removably mounted generally elongated left side panel protective insert of electrically conductive material can be readily secured to, and readily removed from, said generally elongated left side panel.

9. The brassiere as defined in claim 1; further comprising brassiere fastening means for removably securing said protective brassiere around the thoracic cage of the user.

10. The brassiere as defined in claim 9, wherein said brassiere fastening means is disposed at said distal side of said generally elongated right side panel and at said distal side of said generally elongated left side panel, said protective brassiere fastening means includes mating parts selected from the group consisting of clasp and hook and loop fasteners.

11. The brassiere as defined in claim 1; further comprising a right shoulder strap that spans from said generally concave-shaped right cup to said generally elongated right side panel and a left shoulder strap that spans from said generally concave-shaped left cup to said generally elongated left side panel.

12. The brassiere as defined in claim 1, wherein said right cup protective insert mounting means includes a generally circular pocket flap that is disposed on said inner surface of said generally concave right cup and together with said inner surface of said generally concave right cup form a generally circular pocket for receiving said removably mounted generally convex-shaped right cup protective insert of electrically conductive material, so that said removably mounted generally convex-shaped right cup protective insert of electrically conductive material can be readily secured to, and readily removed from, said generally concave-shaped right cup; said generally circular pocket of said right cup protective insert mounting means having an open top, so that said removably mounted generally convex-shaped right cup protective insert of electrically conductive material can be secured and removed from above.

13. The brassiere as defined in claim 1, wherein said left cup protective insert mounting means includes a generally circular pocket flap that is disposed on said inner surface of said generally concave left cup and together with said inner surface of said generally concave left cup form a generally circular pocket for receiving said removably mounted generally convex-shaped left cup protective insert of electrically conductive material, so that said removably mounted generally convex-shaped left cup protective insert of electrically conductive material can be readily secured to, and readily removed from, said generally concave-shaped left cup.

14. The brassiere as defined in claim 1, wherein said right side panel protective insert mounting means includes a generally elongated pocket flap that is disposed on said inner surface of said generally elongated right side panel and together with said inner surface of said generally elongated right side panel form a generally elongated pocket for receiving said removably mounted generally elongated right side panel protective insert of electrically conductive material, so that said removably mounted generally elongated right side panel protective insert of electrically conductive material can be readily secured to, and readily removed from, said generally elongated right side panel; said generally elongated pocket of said right side panel protective insert mounting means having an open top, so that said removably mounted generally elongated right side panel protective insert of electrically conductive material can be secured and removed from above.

15. The brassiere as defined in claim 1, wherein said left side panel protective insert mounting means includes a generally elongated pocket flap that is disposed on said inner surface of said generally elongated left side panel and together with said inner surface of said generally elongated left side panel form a generally elongated pocket for receiving said removably mounted generally elongated left side panel protective insert of electrically conductive material, so that said removably mounted generally elongated left side panel protective insert of electrically conductive material can be readily secured to, and readily removed from, said generally elongated left side panel; said generally elongated pocket of said left side panel protective insert mounting means having an open top, so that said removably mounted generally elongated left side panel protective insert of electrically conductive material can be secured and removed from above.

16. The brassiere as defined in claim 2; further comprising a second layer of fabric disposed on said at least first layer of fabric and strategically stitched thereto so as to form a generally circular pocket for receiving said removably mounted generally convex-shaped right cup protective insert of electrically conductive material, a generally circular pocket for receiving said removably mounted generally convex-shaped left cup protective insert of electrically conductive material, a generally elongated pocket for receiving said removably mounted generally elongated right side panel protective insert of electrically conductive material, and a generally elongated pocket for receiving said removably mounted generally elongated left side panel protective insert of electrically conductive material.

* * * * *